US005626123A

United States Patent [19]

Johnson et al.

[11] Patent Number: 5,626,123

[45] Date of Patent: May 6, 1997

[54] COMPRESSED AIR GUN

[75] Inventors: Lonnie G. Johnson, Smyrna; John Applewhite, Atlanta, both of Ga.

[73] Assignee: Johnson Research & Development Co., Inc., Smyrna, Ga.

[21] Appl. No.: 429,604

[22] Filed: Apr. 27, 1995

Related U.S. Application Data

[63] Continuation of Ser. No. 223,559, Apr. 6, 1994, Pat. No. 5,553,598.

[51] Int. Cl.[6] ..... F41B 11/26; F41B 11/32

[52] U.S. Cl. ..... 124/69; 124/63

[58] Field of Search ..... 124/56, 63–67, 124/69, 75

[56] References Cited

U.S. PATENT DOCUMENTS

| | | | |
|---|---|---|---|
| D. 78,206 | 4/1929 | Hermann . | |
| D. 159,040 | 6/1950 | Bicos | D30/1 |
| D. 191,686 | 10/1961 | Johnson et al. | D62/2 |
| D. 200,473 | 3/1965 | Sawyer | D31/3 |
| D. 265,221 | 6/1982 | Hardin | D21/147 |
| D. 285,327 | 8/1986 | Yano | D21/147 |
| D. 297,748 | 9/1988 | Marino | D21/147 |
| D. 303,820 | 10/1989 | Wong | D21/147 |
| D. 318,309 | 7/1991 | D'Andrade | D21/147 |
| D. 336,939 | 6/1993 | Salmon et al. | D21/147 |
| D. 338,697 | 8/1993 | Salmon et al. | D21/147 |
| D. 340,750 | 10/1993 | Salmon et al. | D21/147 |
| D. 341,174 | 11/1993 | Salmon et al. | D21/147 |
| D. 341,396 | 11/1993 | Salmon et al. | D21/147 |
| 2,049,194 | 7/1936 | Chapin et al. . | |
| 2,303,510 | 12/1942 | Swebilius | 42/69 |
| 2,409,653 | 10/1946 | Amdur | 124/63 |
| 2,589,977 | 11/1952 | Stelzer | 222/79 |
| 2,733,699 | 2/1956 | Krinsky . | |
| 2,927,398 | 3/1960 | Kaye et al. . | |
| 3,005,495 | 10/1961 | Herberg . | |
| 3,025,633 | 3/1962 | Kaye et al. . | |
| 3,121,292 | 2/1964 | Butler et al. . | |
| 3,197,070 | 7/1965 | Pearl et al. | 222/79 |
| 3,273,553 | 9/1966 | Doyle | 124/3 |
| 3,308,803 | 3/1967 | Walther | 124/69 |
| 3,578,789 | 5/1971 | Ferri | 222/79 |
| 3,962,818 | 6/1976 | Pippin, Jr. et al. . | |
| 4,159,705 | 7/1979 | Jacoby | 124/63 |
| 4,214,674 | 7/1980 | Jones et al. | 222/79 |
| 4,223,472 | 9/1980 | Fekete et al. . | |
| 4,411,249 | 10/1983 | Fogarty et al. | 124/64 |
| 4,441,629 | 4/1984 | Mackal | 222/324 |
| 4,591,071 | 5/1986 | Johnson | 222/39 |
| 4,630,757 | 12/1986 | Yano | 222/79 |
| 4,706,848 | 11/1987 | D'Andrade | 222/79 |
| 4,735,239 | 4/1988 | Salmon et al. | 141/25 |
| 4,743,030 | 5/1988 | Auer et al. | 273/349 |
| 4,757,946 | 7/1988 | Johnson | 239/99 |
| 4,854,480 | 8/1989 | Shindo | 222/79 |
| 4,897,065 | 1/1990 | Fertig et al. | 446/63 |
| 4,928,661 | 5/1990 | Bordt et al. | 124/69 |
| 5,029,732 | 7/1991 | Wong | 222/79 |
| 5,074,437 | 12/1991 | D'Andrade et al. | 222/79 |
| 5,150,819 | 9/1992 | Johnson et al. | 222/79 |
| 5,184,755 | 2/1993 | Brovelli | 222/79 |
| 5,184,756 | 2/1993 | Amron | 222/79 |
| 5,188,557 | 2/1993 | Brown | 446/212 |
| 5,229,531 | 7/1993 | Song | 42/58 |
| 5,244,153 | 9/1993 | Kuhn et al. | 239/587.5 |
| 5,407,375 | 4/1995 | Johnson | 446/52 |
| 5,471,968 | 12/1995 | Lee | 124/64 |

FOREIGN PATENT DOCUMENTS

| | | | |
|---|---|---|---|
| 728379 | 2/1966 | Canada | 124/67 |
| 2587911-A1 | 4/1987 | France . | |
| 260464 | 5/1970 | U.S.S.R. | 124/69 |
| 431955 | 7/1935 | United Kingdom . | |
| 669983 | 4/1952 | United Kingdom . | |

*Primary Examiner*—John A. Ricci
*Attorney, Agent, or Firm*—Kennedy & Kennedy

[57] ABSTRACT

An air compressed gun (10) is provided having a stock (11), a barrel (12), a trigger (13) and a manual pump (14). The manual pump is coupled to a swivel joint (31) which provides pivotal movement of the pump relative to the barrel so as to allow for a variety of gun configurations and uses.

20 Claims, 3 Drawing Sheets

COMPRESSED AIR GUN

REFERENCE TO RELATED APPLICATION

This application is a continuation in part of application Ser. No. 08/223,559, filed Apr. 6, 1994 now U.S. Pat. No. 5,553,598.

TECHNICAL FIELD

This invention relates to guns, and specifically to compressed air guns which launch projectiles.

BACKGROUND OF THE INVENTION

Guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Guns have also been designed which use compressed air to launch a projectile, as for example air rifles and pellet guns. These guns typically have a pump handle which is pivotally mounted below the barrel of the gun. A supply of compressed air is generated by repetitively pivoting the handle back and forth with one hand while holding the stock of the gun in the other hand. This pumping action is awkward for small children. Additionally, the repetitive motion of this pumping action quickly tires a child.

Toy guns have also been designed which use compressed air to launch projectiles such as foam darts. This type of gun uses a reciprocating air pump mounted beneath and parallel to the barrel of the gun. In use the pump must be reciprocated many times with each firing of the gun. Therefore, once again a small child may become quite weary with extended use of the gun. These guns also are static in construction, use and aesthetics. Therefore, children often become bored with the operation of them.

Accordingly, it is seen that a need remains for an air gun having a manually operated pump which may be repetitively actuated by a child without tiring and which may be reconfigured to be used a variety of manners to enhance versatility operation. It is to the provision of such therefore that the present invention is primarily directed.

SUMMARY OF THE INVENTION

In a preferred form of the invention a compressed air gun has a stock, a barrel mountned to the stock, and manual pump means for pressurizing a supply of air. The manual pump means includes an air cylinder, a cylinder rod and a handle mounted to the cylinder rod. The pump means is pivotally mounted to the stock for movement between a plurality of manually operable pump positions relative to the barrel. The gun also has trigger means for triggering the release of pressurized air into the barrel. So constructed, the pump may be positioned in a variety of positions to enable it to be actuated in a number of ways to reduce fatigue. Additionally, the variety of positions gives the gun a dynamic appearance and operation.

DETAILED DESCRIPTION

Figure 1:
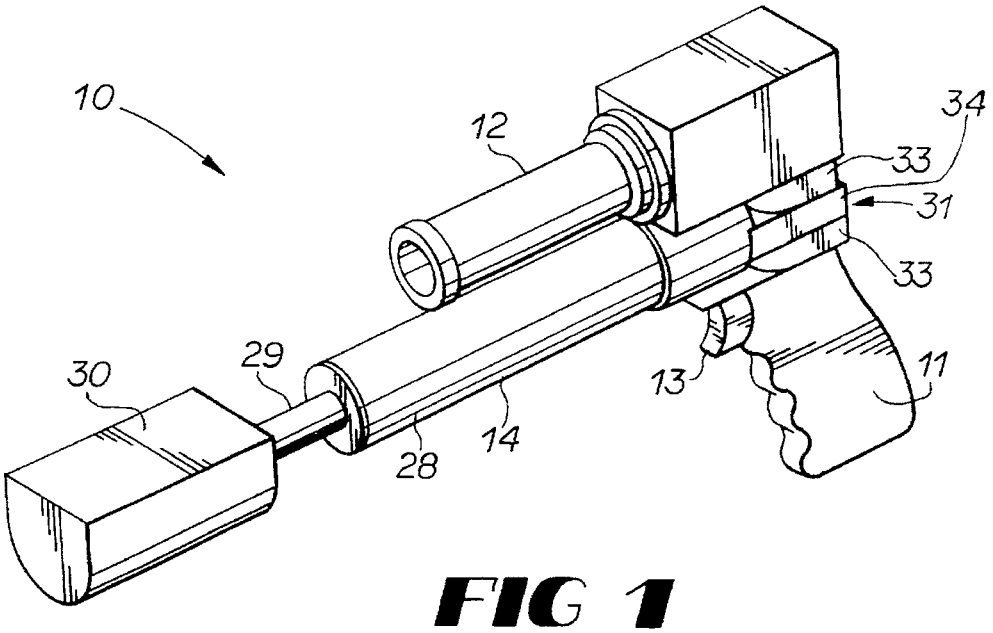
FIG. 1 is a perspective view of an air compressed toy gun embodying principles of the present invention in a preferred form.
Figure 2:
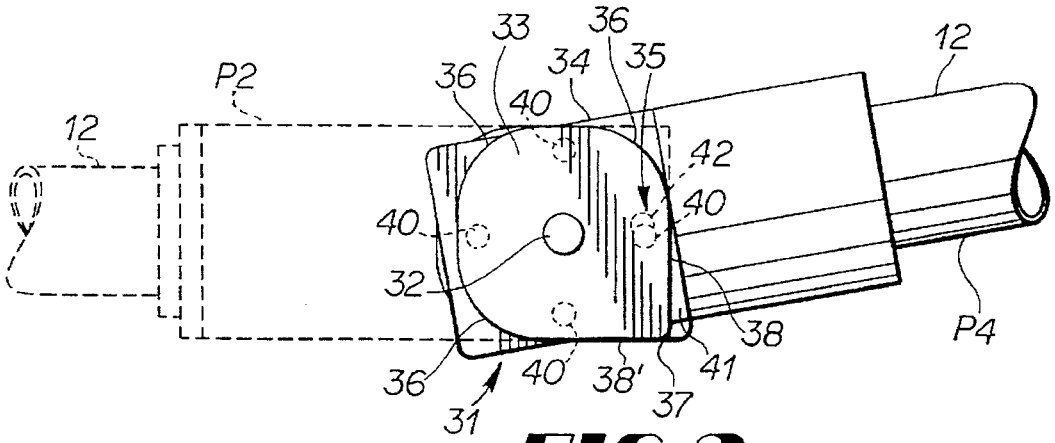
FIG. 2 is a perspective view of a portion of the toy gun of FIG. 1.

With reference next to the drawings, there is shown a toy gun 10 having a stock or handle 11, a barrel 12 mounted to the stock 11, a trigger 13, and a manual pump 14. A projectile P in the form of a suction cup dart with a longitudinal bore mounted within barrel 12. The gun 10 has a pressure chamber 15 adapted to receive and store a supply of air at elevated pressure levels, and a flexible pressure tube 16 extending between the pump 14 and the pressure chamber 15 and also coupled to the trigger 13. A release valve 17 is mounted in fluid communication with the pressure tube 16 and the pressure chamber 15. The release valve 17 has a cylindrical manifold 18 mounted within the pressure chamber 15 and a cylindrical plunger 19 slidably mounted within manifold 18. The pressure chamber 15 has an opening 20 therein in fluid communication with barrel 12.

Figure 3:
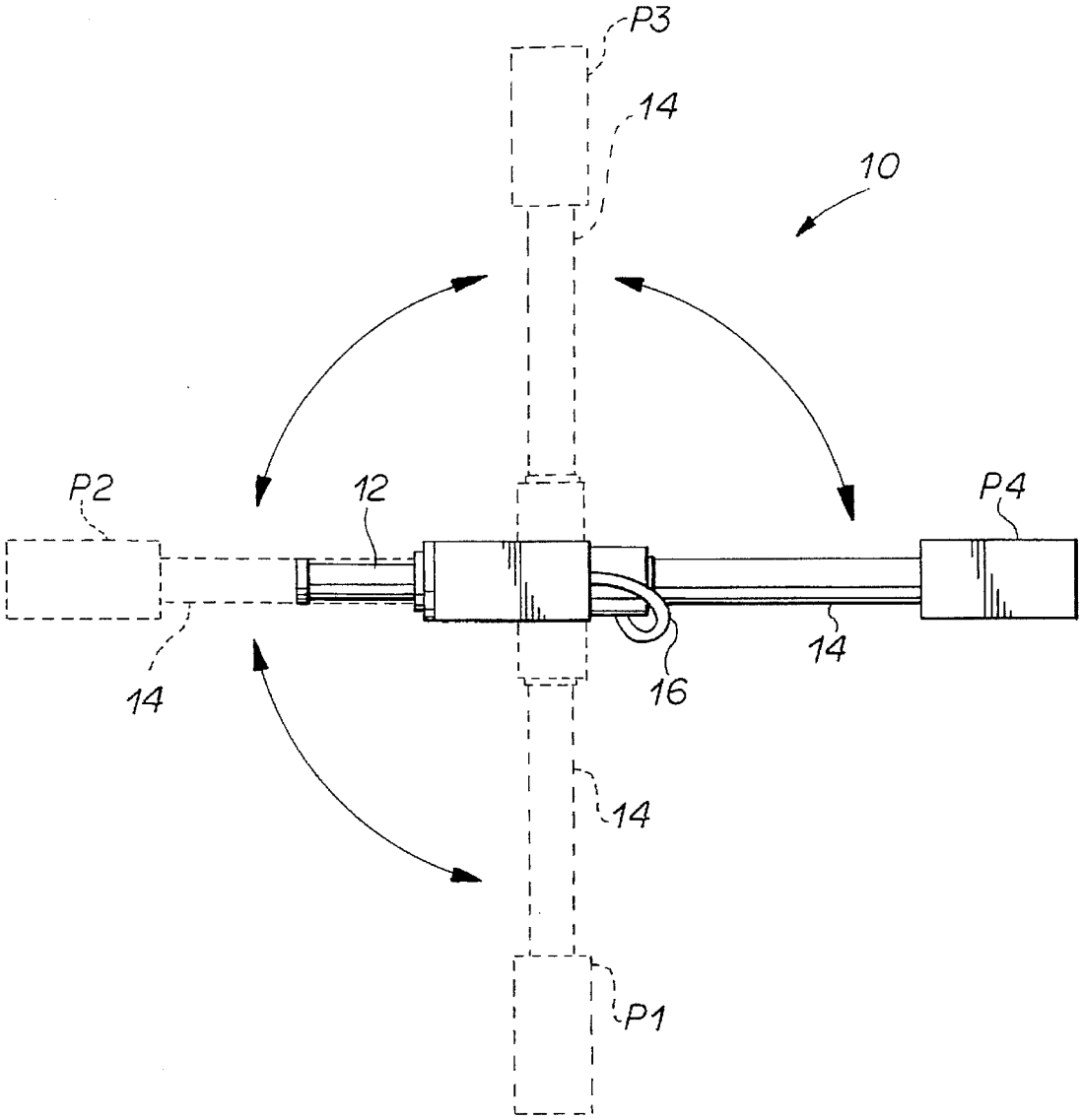
FIG. 3 is a top view of the toy gun of FIG. 1 showing the pump n several operative positions.
Figure 4:
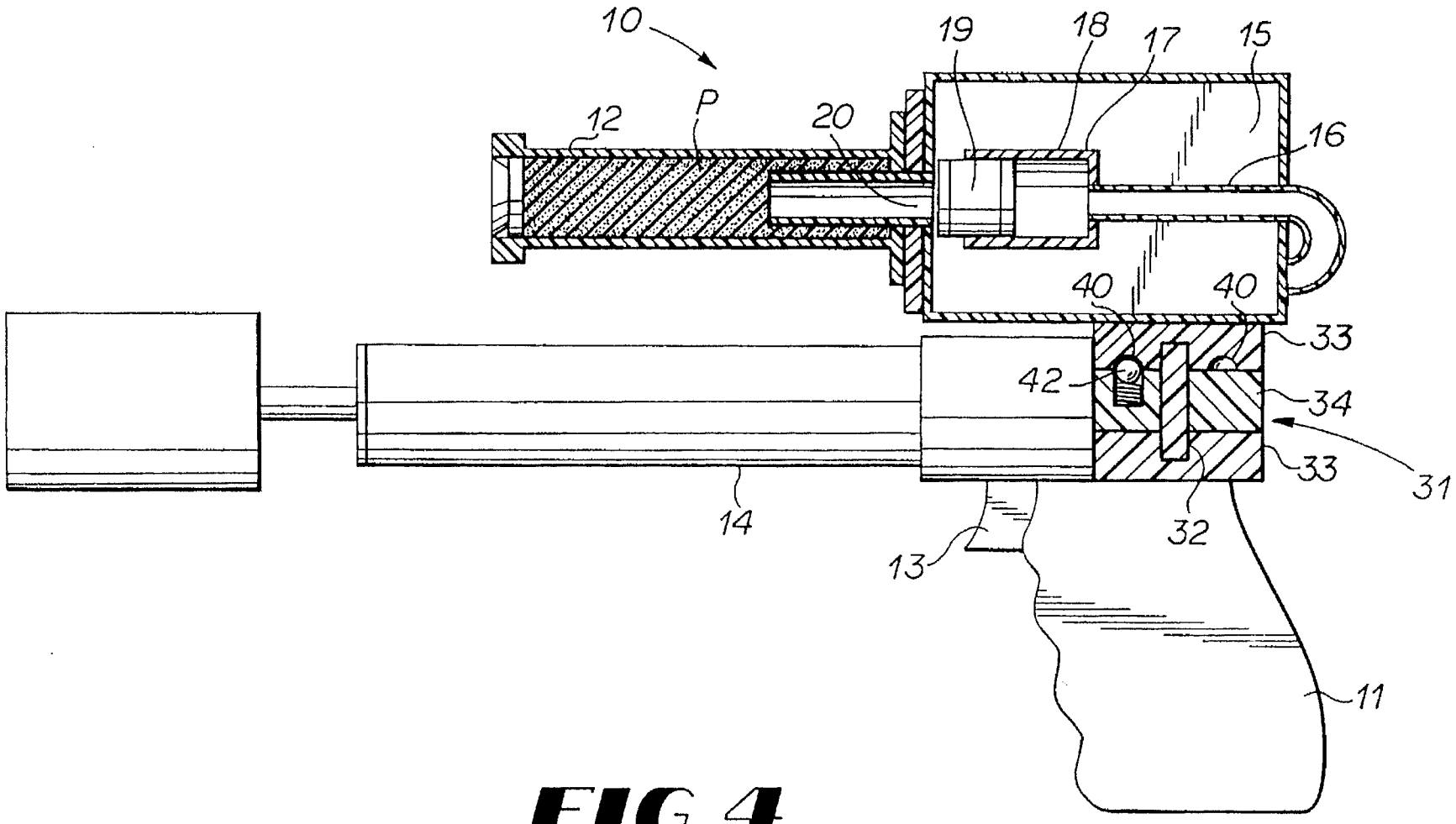
FIG. 4 is a side view, shown in partial cross-section, of the toy gun of FIG. 1.

The pump 14 includes a conventional cylinder 28, a cylinder rod 29 and a handle 30 mounted to an end of the cylinder rod 29. The pump 14 is mounted to the stock 11 by a swivel joint 31. The swivel joint 31 has a fixed stock portion 33, a pivotable pump portion 34, a pivot rod 32 coupling the pump portion 34 to the stock portion 33, and a ball and socket type detent 35. The stock portion 33 has three rounded corners 36, a squared corner 37, and a pair of stop walls 38 and 38' extending from squared corner 38. The stock portion 33 also includes four detent sockets 40 which comprise a portion of detent 35. The pump portion 34 has a guide wall 41 configured to abut stop walls 38 and 38' of stock portion 33 with the pump 14 in a rearward pump position P4, as illustrated in FIG. 3. The pump portion 34 also has a spring biased ball 42 which is sized and shaped to be releasably held in each of the detent sockets 40 of the stock portion.

In use, the manual pump 14 may be positioned in one of the following positions best shown in FIG. 3: a leftward position P1, a forward position P2, a rightward position P3, and a rearward position P4. With the pump in one of the aforementioned positions the spring biased ball 42 of the swivel joint pump portion 34 is held within one of the four detent sockets 40 of the stock portion 33 so as to maintain the pump in position. An operator may then actuate the pump to pressurize a supply of air by grasping the handle 30 and reciprocating the cylinder rod 29 back and forth within the cylinder 28. The pressurized air is passed through the tube 16 into the pressure chamber manifold 18. The compressed air causes the plunger 19 to move into a forward position sealing opening 20. Continued actuation of the pump causes pressurized air to flow between the plunger 19 and the manifold 18 so as to pressurize the pressure chamber 15. With the actuation of trigger 13 compressed air within tube 16 is released causing the plunger 19 to move to a rearward position unsealing opening 20 which allows the pressurized air within the pressure chamber to flow through the opening 20 and into the barrel 12. Pressurized air within barrel 12 propels the projectile P thereout. The actuation of this type of release valve and trigger is describe in more detail in U.S. Pat. No. 5,407,375.

Should it be desired to move the pump 14 from one position to another, an operator simply places enough force on the pump, in the direction of the desired position, to displace the swivel joint spring biased ball 42 from detent socket 40. The pump is guidedly pivoted to the desired position through the actuation of swivel joint 31. Once the pump is repositioned to one of the aforementioned position P1, P2, P3 or P4 the spring biased ball 42 once again is forced into the respective detent socket 40 associated with that position to maintain the position of the pump.

Should the pump be in position P4 the stop wall 38 of stock portion 33 abuts the guide wall 41 of the pump portion 34 and the squared corner 37. The configuration of the squared corner 37 prevents movement of the guide wall thereabout, thus preventing the pump from being rotated directly from position P4 to position P1. Likewise, should the pump be in position P1 tire stop wall 38' abuts the guide wall 41 of the pump portion 34 and the squared corner 37. Again, the configuration of the squared corner 37 prevents movement of the guide wall thereabout, thus preventing the pump from being rotated directly from position P1 to position P4. This prevents the flexible tube 16 from being wrapped about the stock should the pump be repetitively pivoted in the same direction. Alternatively, the flexible tube may be passed through the center of swivel joint 31, however, this would require that the flexible tube be comprised on more than one section with seals between the stock portion and pump portion which allow relative movement therebetween while maintaining the pressure within the tube.

With the pump 14 in position P2 the operator may grasp the stock 11 in his or her right hand while grasping and operating the pump handle 30 in his left hand. This allows the operator to actuate the pump by pulling his left hand towards him. With the pump in position P4 the operator may grasp the stock in his left hand while grasping the pump handle 30 in his right hand. This allows the operator to actuate the pump by pushing his right hand away from him. With the pump 14 in positions P1 or P3 the operator grasps the stock and handle in opposite hands thus enabling the operator to actuate the pump by bringing his hands together.

Thus, it should be appreciated that the just described toy gun has the capability of having its manual pump configured in several positions. The variety of positions allow the toy gun pump to be actuated in different manners so as to use different muscles and thereby prolong its constant use. Additionally, this also allows the user to reconfigure the gun to vary its appearance and the manner of use.

While this invention has been described in detail with particular references to the preferred embodiment thereof, it should be understood that many modifications, additions and deletions, in addition to those expressly recited, may be made thereto without departure from the spirit and scope of invention as set forth in the following claims.

We claim:

1. A compressed air gun comprising a stock; a barrel mounted to said stock; manual pump means for pressurizing a supply of air that includes an air cylinder, a cylinder rod and a handle mounted to said cylinder rod, said pump means being pivotally mounted to said stock for movement between a forward position generally parallel to said barrel and facing forward and a rearward position generally parallel to said barrel and facing rearward in a direction substantially opposite to said forward position; and trigger means for triggering the release of pressurized air into said barrel.

2. The compressed air gun of claim 1 further comprising flexible conduit means for conveying pressurized air from said pump to said barrel.

3. The compressed air gun of claim 2 further comprising a stop for limiting the pivotal movement of said pump.

4. The compressed air gun of claim 1 further comprising means for releasably holding said pump in each of said pump positions.

5. The compressed air gun of claim 4 wherein said holding means comprises a detent.

6. A compressed air gun comprising a stock; a barrel mounted to said stock; a manually operated air pump in fluid communication with said barrel; and mounting means for pivotably mounting said pump to said stock for the manual operation of said pump for movement between a forward, operable position generally parallel to said barrel and facing forward and a rearward, operable position generally parallel to said barrel and facing rearward in a direction substantially opposite to said forward position.

7. The compressed air gun of claim 6 further comprising flexible conduit means for conveying pressurized air from said pump to said barrel.

8. The compressed air gun of claim 7 further comprising a stop for limiting the pivotal movement of said pump.

9. The compressed air gun of claim 6 further comprising means for releasably holding said pump in each of said pump positions.

10. The compressed air gun of claim 9 wherein said holding means comprises a detent.

11. The compressed air gun of claim 6 further comprising triggering means for releasing air into said barrel.

12. In a compressed air actuated gun of the type having a stock, a barrel mounted to the stock, a manual pump for compressing a supply of air, and a conduit for conveying compressed air to the barrel, the improvement comprising, means for pivotably mounting said manual pump for movement between a forward operable, position generally parallel to said barrel and facing forward and a rearward, operable position generally parallel to said barrel and facing rearward in a direction substantially opposite to said forward position.

13. The improvement of claim 12 further comprising flexible conduit means for conveying pressurized air from said pump to said barrel.

14. The improvement of claim 13 further comprising a stop for limiting the pivotal movement of said pump.

15. The improvement of claim 12 further comprising means for releasably holding said pump in each of said pump positions.

16. The improvement of claim 15 wherein said holding means comprises a detent.

17. The improvement of claim 12 further comprising triggering means for releasing air into said barrel.

18. A compressed air gun comprising a stock; a barrel mounted to said stock; manual pump means for pressurizing a supply of air that includes an air cylinder, a cylinder rod and a handle mounted to said cylinder rod, said pump means being pivotally mounted to said stock for movement between a plurality of manually operable pump positions relative to said barrel; trigger means for triggering the release of pressurized air into said barrel; and holding means for releasably holding said pump in each of said pump positions, said holding means having a detent.

19. A compressed air gun comprising a stock; a barrel mounted to said stock; a manually operated air pump in fluid communication with said barrel; mounting means for pivotably mounting said pump to said stock for the manual operation of said pump in a plurality of positions relative to said barrel; and holding means for releasably holding said pump in each of said pump positions, said holding means having a detent.

20. In a compressed air actuated gun of the type having a stock, a barrel mounted to the stock, a manual pump for compressing a supply of air, and a conduit for conveying compressed air from to the barrel, the improvement comprising, means for pivotably mounting said manual pump in a plurality of manually operable positions relative to the barrel; and holding means for releasably holding said pump in each of said pump positions, said holding means having a detent.

* * * * *